United States Patent [19]

Kunze

[11] 4,325,492

[45] Apr. 20, 1982

[54] COVERED CONTAINER

[75] Inventor: Walter A. Kunze, Coraopolis, Pa.

[73] Assignee: Cities Service Company, Tulsa, Okla.

[21] Appl. No.: 152,289

[22] Filed: May 22, 1980

[51] Int. Cl.[3] ..... B65D 43/24

[52] U.S. Cl. ..... 220/335; 220/1 T; 206/519

[58] Field of Search ..... 220/1 T, 335, 337, 338, 220/339; 206/515, 518, 519, 520

[56] References Cited

U.S. PATENT DOCUMENTS 2,765,949 10/1956 Hillman ..... 220/338

3,841,528 10/1974 Eisenberg ..... 206/515 X 3,900,106 8/1975 Contales ..... 206/519

4,220,253 9/1980 Thomas et al. ..... 220/338

*Primary Examiner*—George T. Hall

*Attorney, Agent, or Firm*—Walter M. Benjamin

[57] ABSTRACT

A receptacle device comprising a tapered container having an opening and a cover pivotally attached to the opening in such a manner that the cover opens free of the opening so that a series of containers can be nested one within another without interference with the attachment of the covers and secondarily allowing easy placement and removal of sacks, bags or liner inserts.

10 Claims, 5 Drawing Figures

COVERED CONTAINER

BACKGROUND OF THE INVENTION

This invention relates to a receptacle for liquid and solid materials and more particularly relates to a receptacle comprising a container and a cover and even more particularly relates to a covered receptacle which cover is attached in a manner which allows the cover to be free of the opening when in the open position and which receptacle is useful for common household use.

Receptacles of various styles and designs have been sold for household use. These include receptacles which are covered and which are commonly used for disposing refuse. The covers may be detachable or fixed and pivots on the container at the opening to open and close the receptacle. Sacks, bags or liners are used as inserts to be removed and disposed with the contents after the receptacle is filled.

Oftentime these receptacles do not have enough taper. Therefore they cannot be compactly stacked by nesting one within another. This is an important feature when transportation and storage costs of the receptacles are a factor. Also, a little taper is not amenable to an attractive stacked display for commercial merchandising to the consumer. Hence, the receptacle becomes overpriced owing to overhead and moves slowly owing to a relatively limited display and relatively limited storage space.

When these receptacles are tapered, they may have a removable cover or a permanently or semi-permanently fixed cover which obstructs the opening because of the placement of the pivot points inside the opening, thus necessitating removing the covers for nesting the receptacles and for removing an insert. By semi-permanently fixed is meant a cover which is actually removable, but not meant to be removed, e.g., removing by distorting a plastic container. The removable covers are usually stored in the top receptacle of a stack comprising many receptacles nesting with each other. In this case transportation and storage costs are reduced and display is facilitated but the covers are often misplaced and lost. Frequently at retail a consumer purchases the container thinking the receptacle has no cover or buys the wrong cover by mistake. The container and cover may also be stocked in different locations thus causing confusion on the part of the consumer in locating the cover. Also loose covers create messy store displays.

The permanent or semi-permanent cover do not easily allow for compact stacking for shipping, storage and/or display. Hence, this item is impractical for marketing. This cover causes an inconvenience in placing an insert into and removing an insert from the container. This limits the capacity of the container, impedes the removal of a filled insert as well as causes accidents of spilling refuse when removing an insert from the container. It often results in breakage of pivot pins which can occur during removal and replacement of the covers over a period of time.

Often these receptacles are not deeply drawn because, even if they are tapered, they seriously bind once nested with another container.

SUMMARY OF THE INVENTION

These and many other disadvantages are overcome by the present invention while at the same time all of the aforementioned advantages are not lost. A receptacle device comprising a combination of a deeply drawn tapered container having an opening and a cover pivotally attached to the opening in such a manner that a series of containers can be nested one within another without interference by the covers and secondarily allowing easy placement and removal of sacks, bags or liner inserts. Accordingly in one embodiment of the present invention the cover pivot axis falls directly above or behind a straight rear rim of the container opening thus allowing the cover to pivot clear of the opening. This receptacle is preferably made of a size that can use common grocery standard bags and/or standard plastic film liners as an insert.

BRIEF DESCRIPTION OF THE DRAWINGS

Further advantages and features will be apparent from the following description and from the drawings in which.

DETAILED DESCRIPTION OF THE INVENTION

Figure 1:
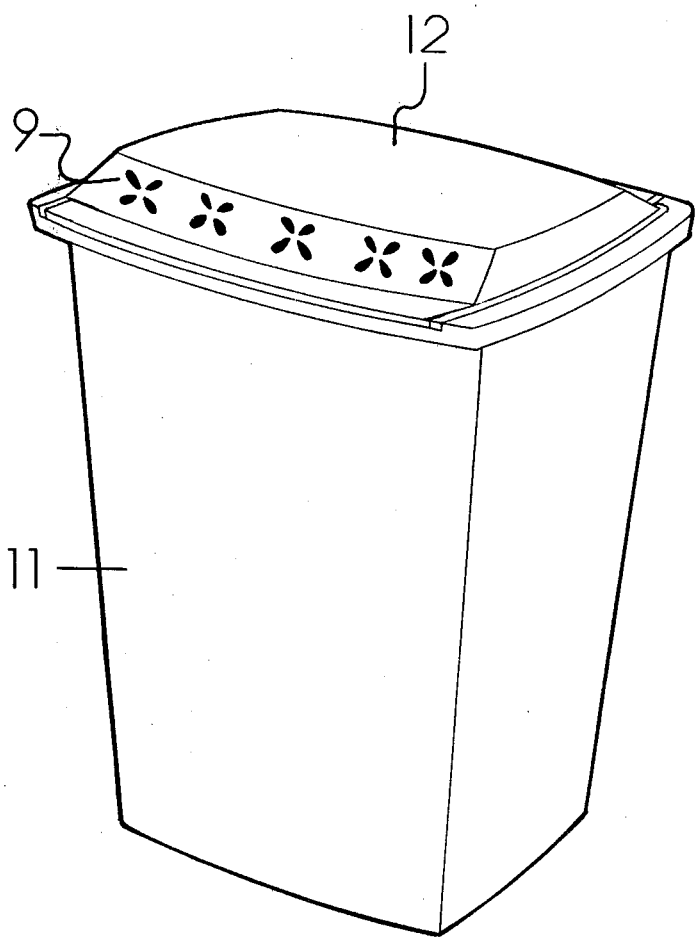
FIG. 1 is a front view of a receptacle device.

According to the present invention a receptacle device is provided. This device comprises a deeply drawn tapered container having an opening and a cover pivotally mounted over the opening in such a manner that a series of containers can be nested one within another without interference with the covers and secondarily allowing easy placement and removal of sacks, bags or liner inserts.

The container of the present invention must be tapered and deeply drawn, e.g. at least about 18 to 20 inches in height. Preferably the container is no taller than about 21 inches so that it would be a convenient height for the standard size grocery bag. Though, many other sizes are also possible for many uses, especially where various sizes of plastic and other type liners are available to fit the container. However, the invention is especially adaptable to household use and preferably kitchen use.

The taper on this container should be slight but there should be at least enough taper so that the bottom of a first container can be inserted into the opening of the top of a second container, and so on so that many containers can be compactly nested. Although, too much taper on the container would not allow a convenient fit for a straight insert such as a standard size grocery bag. Not enough taper will cause binding once a stack of receptacles are nested. A balance between these considerations is acertainable by those skilled in the art of designing receptacle devices. A taper between about $1\frac{1}{2}°$ and $3\frac{1}{2}°$ is preferred. For example, it has been found that a $2\frac{1}{2}°$ taper is satisfactory for compactly nested receptacle devices 21 inches tall and whereby only 2 inches is added to the stacked height per each stacked receptacle device, yet binding is not a serious problem.

The container preferably has a rim around the opening to add support to the container and to provide for an attachment and bearing for the attached pivoting cover. Preferably one side of the opening is flat or straight to provide for the pivoting cover. Hence, a container having an essentially rectangular cross section is ideal although not necessary.

The cover may or may not be vented and is pivotally attached at or near the opening of the container so that it covers and uncovers the opening as it pivots. The pivot axis falls directly above or behind the rear of the container opening, depending on the overall container design. The rear is defined as the side of the container on which the cover pivots. This pivoting arrangement is made so that when the cover is in the open position, the opening of the container is not obstructed, thus allowing an easy insertion of another receptacle for stacking as well as allowing for the easy placement of inserts in the container.

The cover may be pivoted by a hinge arrangement or equivalent. The cover may or may not be removable. The advantages of the present invention is such that the cover need not be easily removable, but remain attached through shipment, storage, merchandizing and in actual use. The pivoting and attaching arrangement includes a pin and hole arrangement where the pin may be on the cover and holes in the rim of the container or vice versa. The rim at the back of the container can be offset back from the opening so that the pivoting axis of the cover allows the open cover to be clear of the opening.

The container and cover can be made of various materials to include plastic and metal and both need not be made of the same material. It is preferred however that the receptacle is injection molded from plastic for ease in manufacturing and for a relatively lower cost.

Reference is now made to FIG. 1 which shows an embodiment of the present invention. Cover 12 is shown in the closed position over the opening of container 11. Vent holes (or design pattern) 9 are shown in cover 12.

Figure 2:
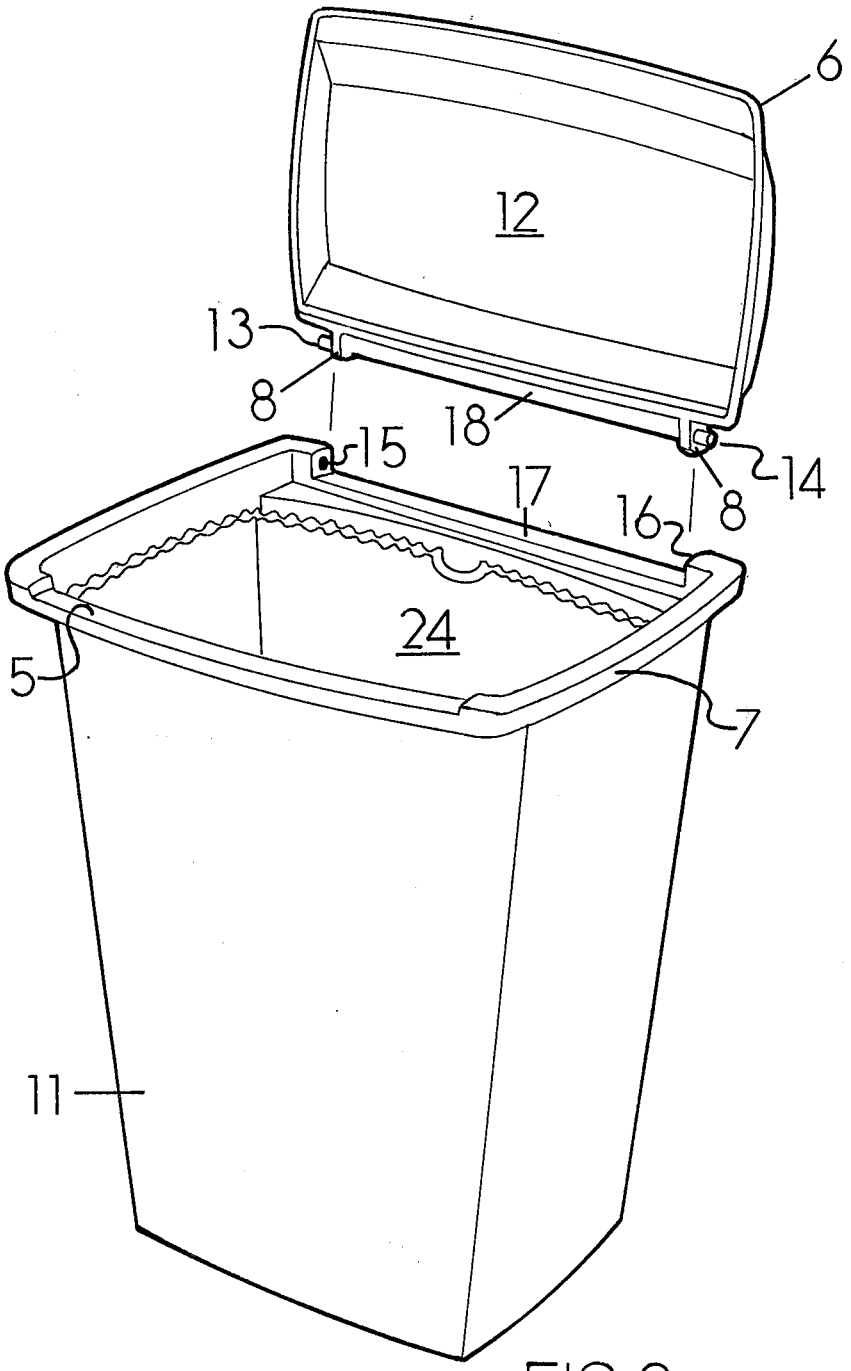
FIG. 2 is a front view of the receptacle device of FIG. 1 with a bag inserted therein and with the cover removed.

Reference is now made to FIG. 2 which shows the receptacle of FIG. 1 where cover 12 is removed from container 11 and a standard size grocery bag 24 is shown inside container 11. Cover 12 is equiped with rounded tabs 8 on which pins 13 and 14 are mounted. Also stop 18 on cover 12 equips the cover with a support when the cover is in the open position. A recess 17 is made into rim 7 of the container 11 so that holes 15 and 16 (16 is not visable in the view) can receive pins 13 and 14 when the cover 12 is assembled to the container 11. The rim 7 is offset from the opening of the container 11 by offset 25 so that the opening of container 11 is clear.

Figure 3:
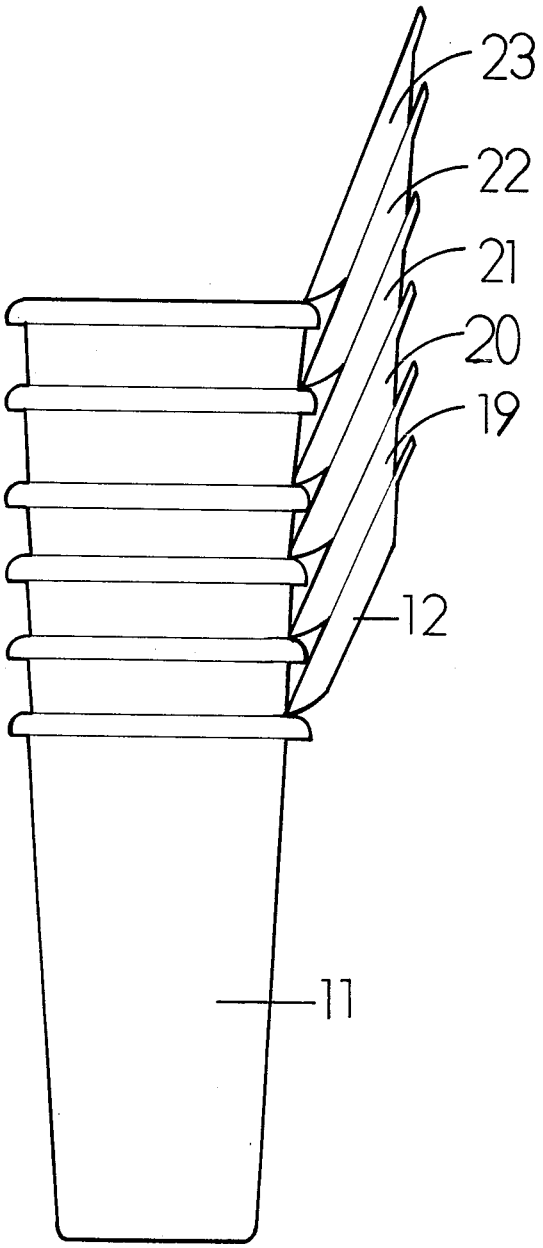
FIG. 3 is a side view of six stacked receptacle devices of FIG. 1 nested one within the other and with the covers open.

Cover 12 is cup shaped partially for design and partially so that when several receptacles are stacked as shown in FIG. 3, covers 23, 22, 21, 20, and 19 fit into the cup of the cover 22, 21, 20, 19 and 12 respectively below. FIG. 2 shows a recess 5 in rim 7 to receive lip 6 of the cover 12. When the cover 12 is attached to the container 11 and in the closed position, lip 6 extends beyond rim 7 so cover 12 can be easily grasped for opening.

Figure 5:
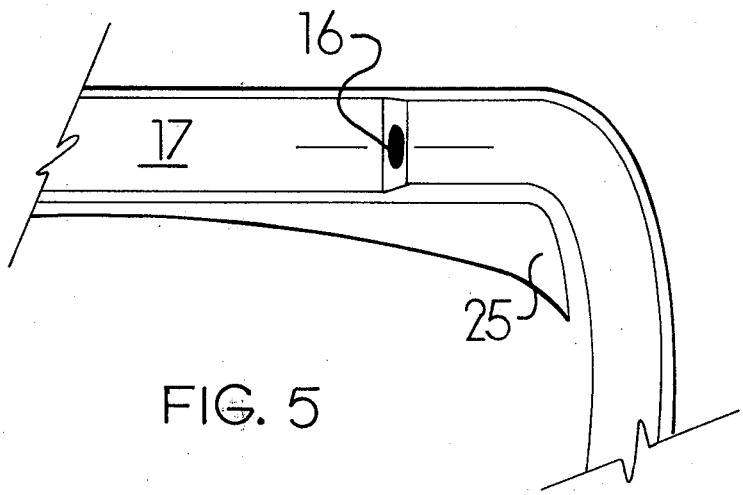
FIG. 5 is a partial top view of the pivot point at which the cover of the receptacle device of FIG. 1 opens.
Figure 4:
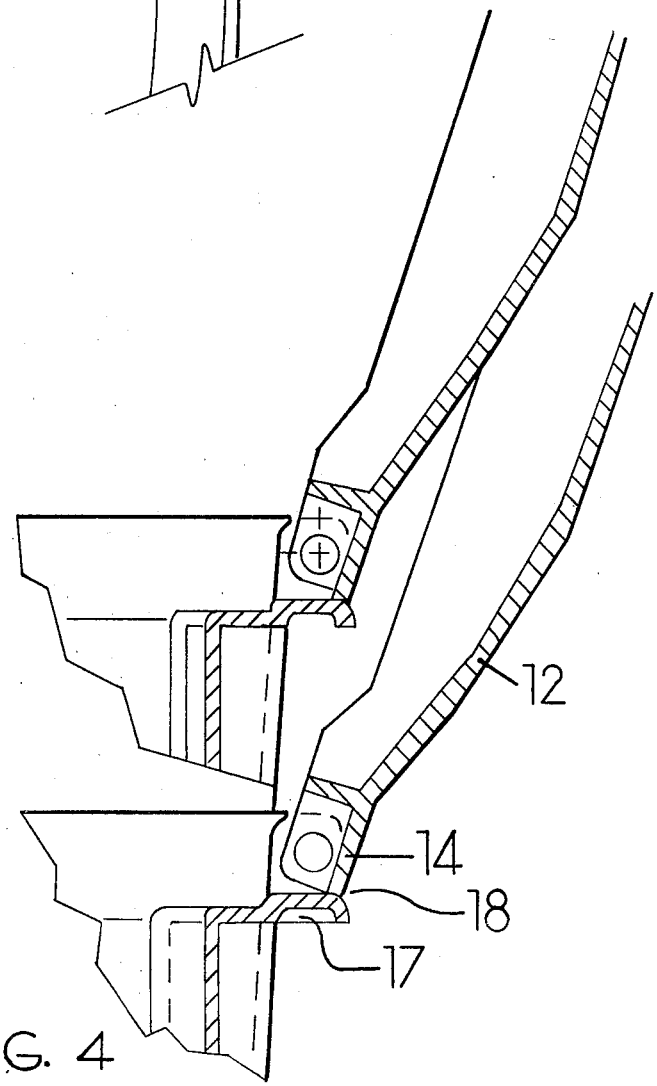
FIG. 4 is a partial section, side view of the pivot point at which the cover of the receptacle device of FIG. 1 opens.

Reference is now made to FIG. 4 and FIG. 5 which show details of the manner in which cover 12 is attached and pivoted on container 11. FIG. 5 shows the offset 25, recess 17 and hole 16. The stop 18 on cover 12 rests on recess 17. Pin 14 is inserted into hole 16. The receptacle is assembled by distorting the container and fitting the two pins 13 and 14 in holes 15 and 16 (see FIG. 2). This would especially be the method of assembly when the receptacle device is made of plastic.

It is apparent that one skilled in the art of designing receptacle devices can modify the embodiments taught herein without departing from the invention concept.

What is claimed is:

1. A receptacle device comprising a cover and a deeply drawn tapered container having an opening having a straight side wherein the cover is pivotally attached to the container at the opening in such a manner that the cover opens and closes the container and wherein the cover is clear of the opening when in the open position.

2. The receptacle of claim 1, wherein the opening in the container is supported by a rim.

3. The receptacle of claim 1, wherein the taper of the container is between about $1\frac{1}{2}°$ and about $3\frac{1}{2}°$.

4. The receptacle of claim 1, wherein the axis of the pivot is offset away from the opening.

5. The receptacle of claim 1, wherein the cover is cup shaped.

6. The receptacle of claim 2, wherein the cover has a lip on its front and the container has a recess in the front rim and wherein the lip mates with the recess.

7. The receptacle of claim 2 wherein the cover has a stop for supporting the cover substantially vertically when in the open position.

8. A receptacle device comprising a cover and a deeply drawn tapered container having an opening supported by a rim, wherein the cover is pivotally attached to the container at the opening in such a manner that the cover opens and closes the container, wherein the cover is clear of the opening when in the open position, wherein the cover is equipped with a stop for supporting the cover substantially vertically and upwardly when in the open position, and wherein the axis of the pivot is offset away from the opening.

9. The receptacle device of claim 1 or 8, wherein the container and cover is attached in such a manner that several receptacles can be stacked by being compactly nested.

10. The receptacle device of claim 1 or 8, wherein the cover is permanently or semi-permanently attached.

* * * * *